United States Patent [19]

Jeschke et al.

[11] Patent Number: 4,838,163

[45] Date of Patent: Jun. 13, 1989

[54] DRIVE SYSTEM WITH DRIVE MEANS FOR AXIAL RECIPROCATION OF DISTRIBUTOR ROLLERS OF AN INKING UNIT

[75] Inventors: Willi Jeschke, Heidelberg; Werner Weber, Sandhausen, both of Fed. Rep. of Germany

[73] Assignee: Heidelberger Druckmaschinen AG, Heidelberg, Fed. Rep. of Germany

[21] Appl. No.: 167,661

[22] Filed: Jul. 11, 1980

Related U.S. Application Data

[63] Continuation of Ser. No. 921,899, Jul. 5, 1978, abandoned.

[30] Foreign Application Priority Data

Jul. 9, 1977 [DE] Fed. Rep. of Germany ..... 2731124

[51] Int. Cl.[4] ..... B41F 31/14

[52] U.S. Cl. ..... 101/349; 101/DIG. 38

[58] Field of Search ..... 101/DIG. 14, 348–350, 101/205–207, 353, 354, 355–358, 359–363, 314, 315, 320, 321, 323, 326, 340, 341, 344, 345

[56] References Cited

U.S. PATENT DOCUMENTS 1,376,982 5/1921 Walser et al. ..... 101/DIG. 14

FOREIGN PATENT DOCUMENTS 242992 4/1911 Fed. Rep. of Germany ... 101/DIG. 14

*Primary Examiner*—J. Reed Fisher

*Attorney, Agent, or Firm*—Herbert L. Lerner; Laurence A. Greenberg

[57] ABSTRACT

Drive system having drive means for axially reciprocating a distributor roller of an inking unit which, in addition to the distributor roller, includes other ink rollers, including additional drive means for superimposing an additional oscillatory movement of the distributor roller in axial direction in the form of a shorter stroke upon a longer stroke effected with the axial reciprocation of the distributor roller by the first mentioned drive means.

3 Claims, 3 Drawing Sheets

Figure 1:
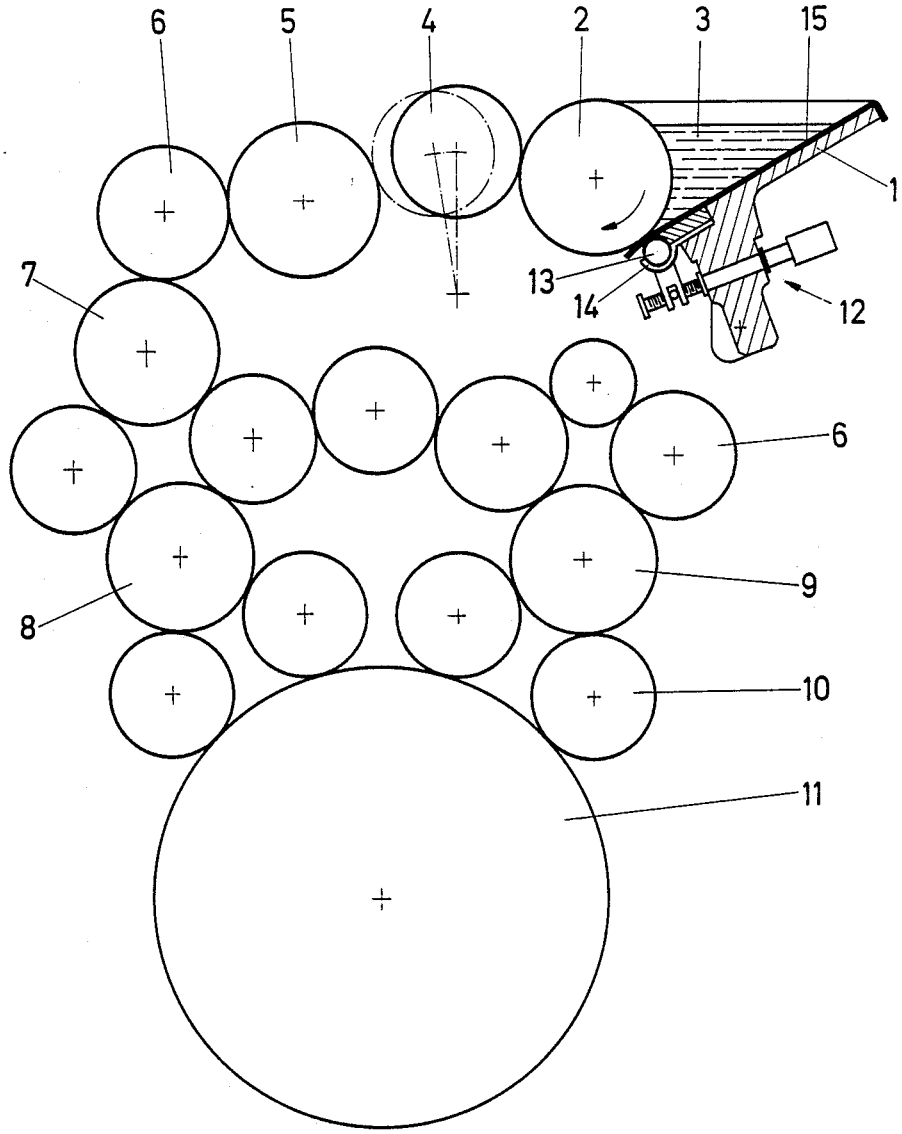

DRIVE SYSTEM WITH DRIVE MEANS FOR AXIAL RECIPROCATION OF DISTRIBUTOR ROLLERS OF AN INKING UNIT

This is a continuation of application Ser. No. 921,899, filed July 5, 1978, now abandoned.

The invention relates to a drive system with drive means for axial reciprocation of the distributor rollers of an inking unit or ink duct, and more particularly, an inking unit having other ink rollers, such as applicator rollers for inking the plate cylinder, for example, in addition to the distributor rollers.

In order to improve printability as well as to homogenize ink flow of high-viscosity printing inks, it has become known heretofore to provide inking units with distributor devices. Such distributor devices are especially supposed to eliminate ink stripes extending in peripheral direction of the plate cylinder. A distributor device conventionally includes a number of distributor rollers disposed in a distributed fashion in the ink roller train, the distributor rollers being reciprocatorily moved axially either through crank transmissions, cam transmissions, swash plates or pneumatic drive systems. The axial movement resulting therefrom generally follows a sinusoidal velocity curve.

If ink-free or ink-poor stripes are produced on the ductor roller extending in peripheral direction due to nonuniform ink zone adjustments or because of a special construction of the ink metering device of the ink duct, it has been found that the heretofore known distributor devices are inadequate to achieve sufficient homogenization of the ink flow.

It is, accordingly, an object of the invention to provide a drive system with drive means for axial reciprocation of distribution rollers of an inking unit which reliably breaks up or resolves, by improved distribution, inking stripes intentionally or accidentally produced on the ductor roller.

With the foregoing and other objects in view, there is provided, in accordance with the invention, a drive system having drive means for axially reciprocating a distributor roller of an inking unit which, in addition to the distributor roller, includes other ink rollers, comprising additional drive means for superimposing an additional oscillatory movement of the distributor roller in axial direction in the form of a shorter stoke upon a longer stroke effected with the axial reciprocation of the distributor roller by the first-mentioned drive means.

The shorter stroke additional movement of the distributor roller clearly produces an improvement in the distributory effect. If ink-free peripheral stripes are present on the ductor roller, it has been found to be particularly effective if the distributor roller immediately downstream of the lifter roller executes the superimposed reciprocatory movement. It is also possible to provide a plurality of distributor rollers with additional drive means in order to produce a superimposed movement.

In accordance with another feature of the invention, the additional drive means is of such construction that the shorter stroke of the distributor roller is executed during one revolution, and the ratio of the rotary speed of the distributor roller to the rotary speed of the plate cylinder is other than a whole number. Consequently, the lifter roller, which is generally driven at half revolution in relationship to the rotary speed of the plate cylinder, as viewed in axial direction, always comes into contact with a different location of the distributor roller with the result that ink-free peripheral stripes partly overlap with ink-carrying stripes. This additionally accelerates the resolution or break-up of the stripes.

In accordance with a concomitant feature of the invention and especially desirable spatially, is an embodiment of the invention which includes journal means rotatably mounting the distributor roller, the first-mentioned drive means comprising a slotted ring carried by the journal means, a pivotable double lever having an end, an entrainer roller mounted at the end of the double lever, crank transmission means connected to the double lever for initiating the longer stroke through the intermediary of the entrainer roller and through the intermediary of the slotted ring, the slotted ring having a slot formed therein and defined by a surface having a pitch extending in axial direction for producing the shorter stroke. In this case, an entrainer ring has thus been exchanged for a slotted ring formed with a slot defined by a surface having a pitch in axial direction. Thus, practically no additional components are required. It is also unnecessary to enlarge the installation space.

Other features which are considered as characteristic for the invention are set forth in the appended claims.

Although the invention is illustrated and described herein as embodied in a drive system with drive means for axial reciprocation of distributor rollers of an inking unit, it is nevertheless not intended to be limited to the details shown, since various modifications and structural changes may be made therein without departing from the spirit of the invention and within the scope and range of equivalents of the claims.

Figure 2:
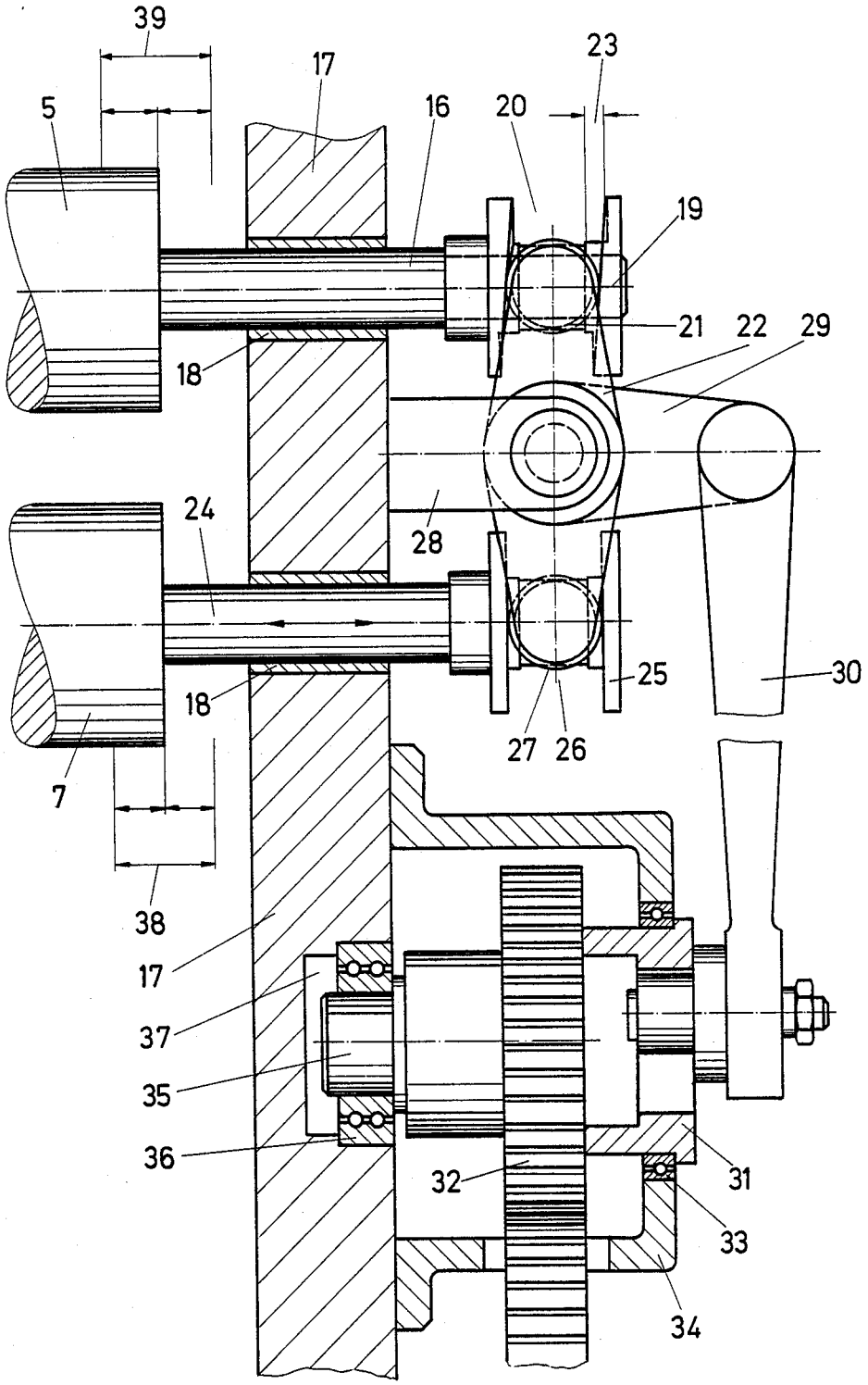
Figure 3:
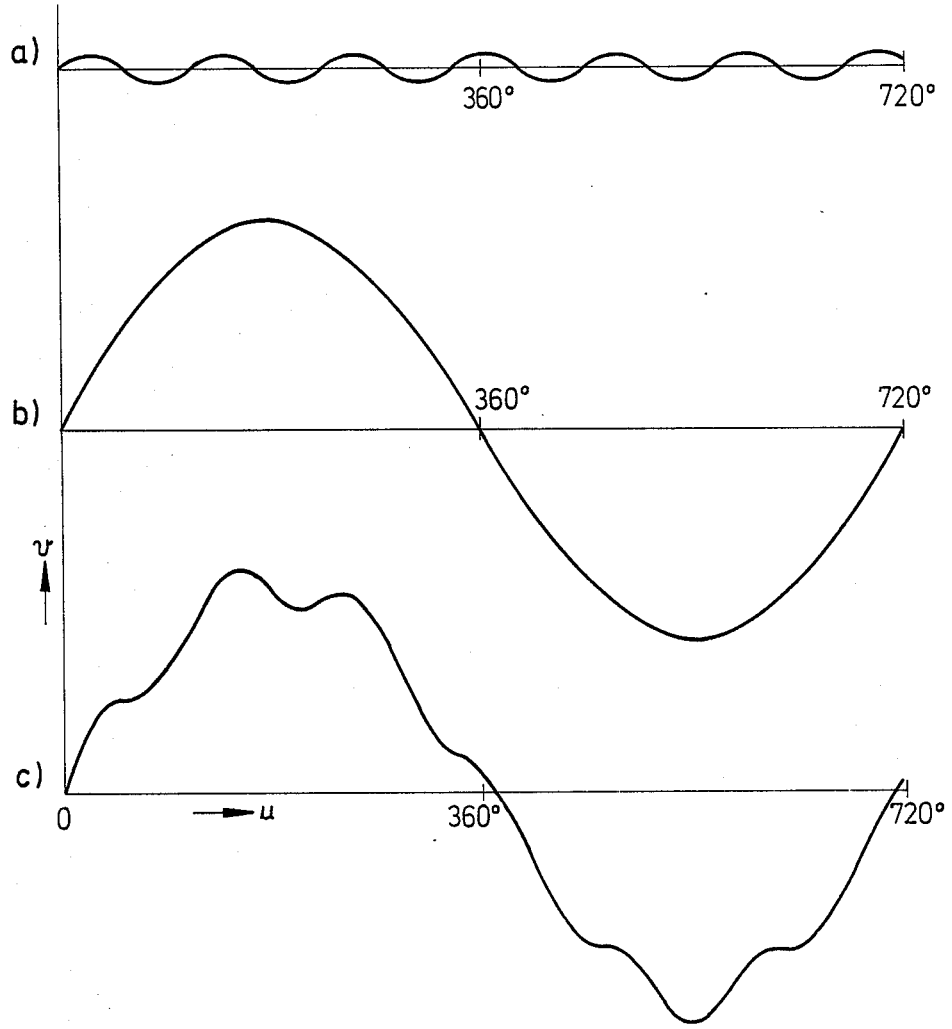

The construction and method of operation of the invention, however, together with additional objects and advantages thereof will be best understood from the following description of specific embodiments when read in connection with the accompanying drawings, in which:

FIG. 1 is a diagrammatic side elevational view, partly in section, of an inking unit with four distributor rollers in the inking roller train for use with the drive system according to the invention;

FIG. 2 is a fragmentary sectional view of the drive system for two distributor rollers which are disposed immediately following the lifter roller of the inking unit; and FIG. 3 is a tripartite plot diagram exhibiting curves at a, b and c of the velocity of the lateral distributor movement of the distributor roller cooperating directly with the lifter roller, as a function of the rotation of the plate cylinder of a printing machine.

Referring now to the drawing and first, particularly, to FIG. 1 thereof, there is shown, as in offset or relief printing machines, an ink duct 1 having associated therewith, in a conventional manner, a ductor roller 2, and between which ink 3 is received in a wedge-shaped space. The ductor roller 2 is drivable at variable speed in order to control the overall inking. The ink 3 is fed from the ductor roller 2 through the intermediary of the lifter roller 4 to the distributor roller 5. From the distributor roller 5, the ink 3 passes over an ink roller train made up of rubber rollers 6 and additional distributor rollers 7, 8 and 9 to applicator rollers 10 and from the latter onto the plate of a plate cylinder 11 of a printing unit of the printing machine.

The lifter roller 4 is swung reciprocatingly at half revolutions in relationship to the speed of the plate cylinder 11 i.e. the lifter roller 4 executes one pivoting movement or swing from the ductor roller 2 to the distributor roller 5 during one revolution of the plate cylinder 11, and one pivoting movement or swing from the distributor roller 5 back to the ductor roller 2 during the next revolution of the plate cylinder 11. The ratio of the rotary speed of the distributor roller 5 to the rotary speed of the plate cylinder 11 is not a whole number. In the illustrated embodiment, approximately 3.2 revolutions of the distributor roller 5 correspond to one revolution of the plate cylinder 11.

The ink duct 1 is provided with an ink metering device 12 according to U.S. Pat. No. 4,242,958 issued Jan. 6, 1981 of one of the coinventors of the instant application. The ink metering device 12 is formed of zone-wide adjusting elements 13 disposed closely adjacent one another and extend across the width of the ink duct 1. The adjusting elements 13 are of cylindrical construction and are disposed so as to be rotatable in peripheral direction. A spring 14 embraces the adjusting elements 13 and urges them towards the ductor roller 2. A thin elastic foil 15 is provided between the adjusting elements 13 and the outer or casing surface of the ductor roller 2.

As viewed in axial direction of the ductor roller 2, the adjusting elements 13 exhibit non-illustrated adjacent bracing ribs and groove-like metering regions. The bracing ribs are in continuous contact with the foil 51 and thereby with the ductor roller 2. Since each adjusting element 13 has at least two bracing ribs, two ink-free stripes extending in peripheral direction are produced in the region of an adjustment zone on the outer casing surface of the ductor roller 2, and are transmitted by the lifter roller 4 to the distributor roller 5 precisely like the other ink stripes in accordance with the zonewise ink adjustment.

For a reliable elimination of these ink-free stripes, in accordance with the invention, the distributor roller 5 executes not only a conventional reciprocating movement, the so-called long stroke, but moves additionally in accordance with a superimposed short-stroke oscillatory or reciprocatorily pivoting movement. The construction of the drive system of the distributor roller 5 is shown in detail in FIG. 2.

A journal 16 of the distributor roller 5 is mounted rotatably and axially displaceably by means of a slide bearing 18 in the side wall 17 on the drive side of the printing machine. A slotted ring 19 is located at the free end of the journal 16 outside the machine side wall 17 and is formed with a slot 20 wherein an entrainer roller 21 of a double lever 22 is guided. The slot 20 has a pitch in accordance with which the distributor roller 5 is reciprocated during a revolution. The pitch corresponds to the short stroke 23. In the case at hand, the pitch is 4 mm.

The journal 24 of the additional distributor roller 7 is likewise mounted rotatably and axially displaceably in a slide bearing 18 in the side wall 17 of the printing machine. The journal 24 carries at a free end thereof an entrainer ring 25 formed with a guide slot 26 which has no pitch in direction of the journal 24. The entrainer roller 27, which is rotatably mounted at the other end of the double lever 22, runs in the guide slot 26. The double lever 22 is pivotably disposed in a bearing 28 which is fastened to the side wall of the printing machine. Connected to the double lever 22 is a crank arm 29 which is engaged by a crank 30 which is articulatingly connected eccentrically to the hub 31 of a crank gear 32.

Whereas FIG. 2 shows the double lever 22 in a central position thereof, the part of the crank 30 which is articulatingly connected to the crank gear 32 is illustrated in the top dead center position thereof.

The crank gear 32 is rotatably mounted by means of the hub 31 thereof and a ball-bearing 33 in a housing 34, and at the other side thereof by means of a journal 35 in a ball-bearing 36 which is located in a recess 37 formed in the side wall 17 of the printing machine. The crank gear 32 is set in rotation by the plate cylinder 11 through the intermediary of additional non-illustrated drive means. The eccentric articulating connection of the crank 30 to the hub 31 of the crank gear 32 is such that the double lever 22 is set into a pendulum or swinging movement, whereby the distributor roller 5 is drawn, for example, towards the side wall 17 of the printing machine, the distributor roller 7 moving simultaneously in the opposite direction. The stroke of the distributor roller 7, hereinafter called the long stroke 38, is 35 mm long in the case at hand. For two revolutions of the plate cylinder 11, the double lever 22 executes one reciprocatory pendulum movement. During one revolution of the plate cylinder 11, the distributor roller 7 thus executes the long stroke 38, whereas the distributor roller 5 which, during each of the revolutions thereof, is additionally reciprocated in accordance with the short stroke 23, travels an overall stroke 39 which, in the case at hand, is 35 mm plus the short stroke 23 of 4 mm, and thus 39 mm.

FIG. 3 shows at (a) the velocity diagram of the short stroke 23 of the distributor roller 5 in relationship to the revolution of the plate cylinder 11. As is apparent from (a) of FIG. 3, the slot ring 19 (FIG. 2) effects a reciprocating movement somewhat more than 3 times due to the ratio of speeds of approximately 3.2 of the distributor roller 5 to the plate cylinder 11.

FIG. 3 shows at (b) by contrast, the velocity curve of the distributor roller 7 as a function of the plate cylinder rotation. The long stroke 38 is covered once in one revolution of the plate cylinder 11. But since the distributor roller 5 is both reciprocated once by the crank 30 for two revolutions of the plate cylinder 11, and also simultaneously executes the short stroke movement 23 approximately 6.4 times due to the slotted ring 19, a superimposed sinusoidal movement is set as illustrated in FIG. 3 at (c). This velocity curve has been found to be extraordinarily efficacious for distributing ink to the aforementioned ink-free stripes extending in peripheral direction.

The effect of this superimposed distributory movement can be promoted yet further by, first, as in the illustrated embodiment, making the forward distributor roller 5 in the ink roller train execute the superimposed movement and, second, providing that the ratio of velocities of the distributor roller 5 to the plate cylinder 11 is not a whole number, so that the lifter roller 4 reciprocatorily pivoting a half revolutions always comes into contact with the distributor roller 5 at a different location than that immediately beforehand. By this means, overlapping of ink-carrying and ink-free stripes is produced from the very beginning.

If necessary, the journals of the remaining distributor rollers 7, 8 and 9 may also be provided with a slotted ring 19 having an axial pitch, so that these distributor rollers likewise execute a superimposed movement.

Furthermore, the invention as not restricted to inking units of the type illustrated in FIG. 1. The additional movement according to the invention may also be of great utility for conventional inking units with ink knife and zonal screws, when the inking at the ink duct has not been adjusted with sufficient uniformity. In this case, also, it has been found that a homogenization of the ink flow by means of the superimposed movement visibly improves the printing results.

Because the additional movement considerably improves the processing of the ink and the homogenization of the ink flow when it is applied to a plurality of distributor rollers, inking rollers can be spread or economized with. The superimposed distributory movement according to the invention therefore makes it possible to shorten the length of the ink roller train.

There are claimed:

1. In combination with an inking unit having an ink duct and a train of ink rollers including a distributor roller for transferring ink from the ink duct to a plate cylinder of a printing machine, the distributor roller being mounted so as to be axially reciprocable, a drive system comprising first drive means for axially reciprocating the distributor roller with a main stroke of given length, and second drive means for superimposing an additional oscillatory movement of the distributor roller in axial direction in the form of a stroke having a length which is a minor fraction of the given length of the main stroke whereby said second drive means periodically accelerates and retards the distributor roller during movement along the path of the main stroke.

2. Drive system according to claim 1 including journal means secured to and rotatably mounting the distributor roller, said second drive means comprising a slotted ring formed with a slot therein and carried by said journal means for rotating with the distributor roller, a pivotably double lever having an end, an entrainer roller mounted at said end of said double lever and engaging in said slot formed in said slotted ring, crank transmission means connected to said double lever for initiating said stroke of given length through the intermediary of said entrainer roller and through the intermediary of said slotted ring, said slot formed in said slotted ring being defined by a surface having a pitch extending in axial direction for producing said shorter stroke.

3. Drive system according to claim 2 wherein said slot is traversible by the entrainer roller along said defining surface during one revolution of the distributor roller so that the shorter stroke of the distributor roller is executed during said one revolution, and the distributor roller is rotatable at a speed forming a ratio with the rotary speed of the plate cylinder which is other than a whole number.

* * * * *